US012134505B2

(12) United States Patent
Zatkoff et al.

(10) Patent No.: US 12,134,505 B2
(45) Date of Patent: Nov. 5, 2024

(54) FOAM PACKAGING ASSEMBLY

(71) Applicant: Roger Zatkoff Company, Farmington Hills, MI (US)

(72) Inventors: David Zatkoff, Farmington Hills, MI (US); Marc Staudt, Farmington Hills, MI (US); Hamilton Marques, Farmington Hills, MI (US)

(73) Assignee: ROGER ZATKOFF COMPANY, Farmington Hills, MI (US)

( * ) Notice: Subject to any disclaimer, the term of this patent is extended or adjusted under 35 U.S.C. 154(b) by 0 days.

(21) Appl. No.: 18/302,451

(22) Filed: Apr. 18, 2023

(65) Prior Publication Data

US 2024/0083647 A1 Mar. 14, 2024

Related U.S. Application Data

(63) Continuation-in-part of application No. 29/868,067, filed on Nov. 18, 2022, now Pat. No. Des. 986,736,
(Continued)

(51) Int. Cl.

| | |
|---|---|
| ***B65D 81/02*** | (2006.01) |
| ***B65B 55/20*** | (2006.01) |
| ***B65D 81/05*** | (2006.01) |

(52) U.S. Cl.
CPC ..... *B65D 65/44* (2013.01); *B65B 55/20* (2013.01); *B65D 81/051* (2013.01); *B65D 2581/055* (2013.01)

(58) Field of Classification Search
CPC ..... B65D 65/44; B65D 81/051; B65D 2581/055; B65B 55/20
(Continued)

(56) References Cited

U.S. PATENT DOCUMENTS

| | | | |
|---|---|---|---|
| 2,867,367 | A | 1/1959 | Butz |
| 3,334,798 | A | 8/1967 | Pezely, Jr. et al. |

(Continued)

FOREIGN PATENT DOCUMENTS

| | | | |
|---|---|---|---|
| CN | 201077589 | Y | 6/2008 |
| DE | 20023776 | U1 | 5/2006 |

(Continued)

OTHER PUBLICATIONS

EzeeCorner Foam Corner Protectors for Shipping, retrieved on Sep. 14, 2022, 2 pages, https://indexpackaging.com/stock-packaging/ezeecorner.

(Continued)

*Primary Examiner* — J. Gregory Pickett
*Assistant Examiner* — Jenine Pagan
(74) *Attorney, Agent, or Firm* — DICKINSON WRIGHT PLLC

(57) ABSTRACT

A foam packaging assembly for protecting an article includes one or more pads including at least one corner pad and at least one side pad disposed between the corner pads, a packaging container configured to receive the article or an inner box storing the article, and a configurator determining one or more dimensions of the container based on at least one input variable of the article or the inner box. The configurator further determines a number of the pads for placement inside the container such that the article with the pads is protected during storage or transport. Further, the foam packaging assembly includes at least one insert board configured for placement over the article inside the container, and the configurator determines one or more dimensions of the insert board when the insert board is selected to be disposed inside the container.

16 Claims, 8 Drawing Sheets

Related U.S. Application Data which is a continuation-in-part of application No. 29/866,491, filed on Sep. 14, 2022, now Pat. No. Des. 986,054, and a continuation-in-part of application No. 29/866,493, filed on Sep. 14, 2022, now Pat. No. Des. 986,055, and a continuation of application No. 29/866,494, filed on Sep. 14, 2022, now Pat. No. Des. 976,108.

(58) Field of Classification Search
USPC ..... 206/523, 585, 586
See application file for complete search history.

(56) References Cited

U.S. PATENT DOCUMENTS

| | | | | |
|---|---|---|---|---|
| 3,404,826 | A | 10/1968 | Carmody | |
| 3,410,474 | A * | 11/1968 | Keil | B65D 81/056 297/DIG. 2 |
| D214,487 | S | 6/1969 | Reichl | |
| D228,062 | S | 8/1973 | Armstrong | |
| 3,854,650 | A | 12/1974 | Hanaue | |
| 3,994,433 | A | 11/1976 | Jenkins et al. | |
| 4,072,231 | A | 2/1978 | Helms | |
| 4,883,179 | A * | 11/1989 | Dionne | B65D 81/057 206/453 |
| 5,175,041 | A | 12/1992 | Webb et al. | |
| D384,585 | S | 10/1997 | Swar | |
| 6,000,545 | A | 12/1999 | Smith | |
| 6,488,153 | B1 * | 12/2002 | Morris | B65D 81/056 206/523 |
| 6,508,362 | B2 | 1/2003 | Hnatow et al. | |
| 6,915,905 | B2 * | 7/2005 | Yoshimura | B65D 81/057 206/592 |
| D584,621 | S | 1/2009 | Jean | |
| D603,263 | S | 11/2009 | Chaimberg | |
| 7,654,391 | B2 | 2/2010 | Langer et al. | |
| 7,810,642 | B2 | 10/2010 | Cheng et al. | |
| 7,913,896 | B2 | 3/2011 | Reinkensmeyer | |
| D640,919 | S | 7/2011 | Lavelle | |
| 8,065,032 | B2 * | 11/2011 | Stifter | B65B 5/12 700/214 |
| D663,206 | S | 7/2012 | Nelson et al. | |
| 8,240,469 | B2 * | 8/2012 | Goda | B65D 19/20 206/386 |
| 8,584,928 | B2 | 11/2013 | Keissner | |
| 8,752,707 | B2 | 6/2014 | Mc Donald et al. | |
| 8,965,559 | B2 * | 2/2015 | Pankratov | B65G 57/09 700/228 |
| 9,290,316 | B2 * | 3/2016 | Van Uum | B65D 85/62 |
| 9,598,217 | B2 | 3/2017 | Giller | |
| 10,227,171 | B2 * | 3/2019 | Wetsch | G05B 19/41865 |
| D854,923 | S | 7/2019 | Denham | |
| D871,213 | S | 12/2019 | Cram | |
| 10,906,720 | B2 | 2/2021 | Ji | |
| D976,108 | S | 1/2023 | Zatkoff et al. | |
| 2001/0017023 | A1 * | 8/2001 | Armington | B65B 55/20 53/472 |
| 2002/0056656 | A1 | 5/2002 | Beliveau | |
| 2005/0055181 | A1 * | 3/2005 | Verdura | G06F 30/00 703/1 |
| 2006/0278555 | A1 | 12/2006 | Langer et al. | |
| 2007/0144936 | A1 | 6/2007 | Stegner et al. | |
| 2008/0092488 | A1 * | 4/2008 | Gabrielsen | B65B 55/20 53/115 |
| 2010/0155290 | A1 * | 6/2010 | Kiessner | B65D 5/5004 206/586 |
| 2013/0048534 | A1 * | 2/2013 | Merrell | B65D 81/03 53/472 |
| 2015/0298884 | A1 | 10/2015 | Zhao et al. | |
| 2018/0029766 | A1 | 2/2018 | Chung et al. | |
| 2018/0305067 | A1 | 10/2018 | Iwahara et al. | |
| 2019/0233194 | A1 | 8/2019 | Zhang et al. | |
| 2020/0122913 | A1 | 4/2020 | Sim et al. | |
| 2021/0039834 | A1 | 2/2021 | Cheng | |
| 2021/0403218 | A1 | 12/2021 | Merrell | |

FOREIGN PATENT DOCUMENTS

| | | | |
|---|---|---|---|
| DE | 202006008937 | U1 | 8/2006 |
| EP | 1433717 | A1 | 6/2004 |
| FR | 127820 | S | 5/1979 |
| JP | 2009241960 | A | 10/2000 |
| JP | D1484305 | S | 11/2023 |
| KR | 20180112945 | A | 10/2018 |
| TW | D198363 | S | 7/2019 |
| TW | D201492 | S | 12/2019 |

OTHER PUBLICATIONS

Foam Corner Guards _ BGR, retrieved on Sep. 14, 2022, 3 pages, https://www.packbgr.com/cornerboard-edge-protection/corner-protectors.asp.

Order Custom Corner Potectors from Cactus Containers, retrieved on Sep. 14, 2022, 4 pages, https://www.cactuscontainers.com/packaging-supplies/corner-protectors.

Corrugated Packaging Supplies _ Foam Corner Protectors, retrieved on Sep. 14, 2022, 2 pages, https://www.westtexascontainer.com/foam-corner-protectors.html.

Corner Keepers_ Foam Corner Protection _ Pregis, retrieved on Sep. 14, 2022, 3 pages, https://www.pregis.com/us-solutions/by-product/specialty-products/corner-keepers.

Foam Protectors in Stock—ULINE, retrieved on Sep. 14, 2022, 1 page, https://www.uline.com/BL_2154/Foam-Protectors.

Kingdom Group _ Foam Corner, retrieved on Sep. 14, 2022, 1 page, https://www.kingdomgroup.com/product/foam-corner.

Interlocking Foam Floor Tiles. Date posted: Jan. 31, 2016. Site visited: Nov. 9, 2022 Available online: https://www.youtube.com/watch?v=cH3NVX-1JTA (Year: 2016).

Dreambaby® Foam Corner Protectors [1302]. Date posted: Apr. 6, 2016. Site visited: Nov. 9, 2022. Available online: https://www.youtube.com/watch?v=WP-TY10pDJE (Year: 2016).

Carton Packing Corner Guard Frame Corner Protectors. Date first available. Jul. 6, 2021. Site visited: Nov. 9, 2022. Available online: https://www.amazon.com/dp/B098PZZ74G?ref _=cm_sw_r_em_ud_dp_WT4JGF7AFZ15K7CG0ES7 (Year: 2021).

Makita T-02571 Customizable Foam Insert for Interlocking Cases. Date first available: Aug. 1, 2014. Site visited: Nov. 18, 2022. Available online: https://www.amazon.com/Makita-T-02571-Customizable-insert-Interlocking/dp/B00me73UD6 (Year: 2014).

* cited by examiner

FOAM PACKAGING ASSEMBLY

CROSS-REFERENCES TO RELATED APPLICATIONS

This application is a continuation-in-part of, and claims priority to and the benefit of U.S. Design Pat. application No. 29/868,067, filed Nov. 18, 2022, which claims priority to and the benefit of U.S. Design Pat. application Nos. 29/866,491 and 29/866,493, filed Sep. 14, 2022 and also U.S. Design Pat. application No. 29/866,494, filed Sep. 14, 2022 (now U.S. Design Pat. No. D976,108, issued Jan. 24, 2023), the contents of which are incorporated herein by reference in their entireties.

FIELD

The present disclosure relates to a packaging assembly for protecting articles, and more particularly to a foam packaging assembly to customize the article's packaging.

BACKGROUND

The statements in this section merely provide background information related to the present disclosure and may not constitute prior art.

Various types of packaging materials are known for packaging and shipping perishable or fragile articles. In some cases, a box containing an article is suspended within another package or box for protection during shipping or storage, and "loose-fill" packaging materials may be used to space and protect the inner articles within the outer box. In particular, the use of "loose-fill" materials such as expanded plastic beads (polystyrene, polyethylene, polypropylene, etc.), may be extruded and cut into a variety of shapes, which can be used to fill a void and surround an article placed inside a shipping container or box to cushion and protect the articles against damage. Accordingly, the fragile devices or articles such as electronic devices, medical devices, glassware, etc., surrounded by the "loose-fill" packaging materials may be protected from the vibration and shock due to the impact.

However, the loose-fill materials provide a low weight "resilient envelope" such that it has been found that heavier articles may wander or settle within the loose-fill medium over time due to vibration during transport. While the loose-fill materials may have good pourability for filling a void or space between an article and its container, they are particularly difficult to dispose of, as the low density and high volume provide tremendous quantities of loose beads that the consumer must deal with and that many waste management companies do not see as recyclable materials. A further disadvantage of the loose-fill materials is that the low density and large volume make storing and transporting the materials before use very inefficient and costly.

Foam-in-place materials provide another option to package articles. Thermoset two-component urethane precursors may be reacted together and poured or sprayed to expand and fill an open space to provide cushioning. Thermoplastic beads may be expanded in shaped molds to form customized sections of packaging for the protection of contents. An alternate means to provide packing materials has been to cut a block or sheet of, for instance, a foamed material to shape. That is, however, an extremely wasteful process as a lot of scrap is generated from the material removed from the blank and usually a lot of dust or debris is generated.

"Bubble-wrap" is another type of packaging for articles, where a sheet of plastic bubbles can be wrapped around an article having a regular shape. However, the ability of "bubble-wrap" to fill irregular shaped spaces or voids is poor and, once again, disposal is difficult, unless one wants to crush all the bubbles to reduce the volume to a practical level. In the packaging of heavy products, further, appliances and the like, corner and top support pads may be provided between a corner of the appliance and an outer container. These pads provide impact protection as well as stacking strength. Often these support pads are formed to shape of paper board and adhesive. They are not however generally reusable in a different configuration.

"Styrofoam" is another type of packaging for articles to cut into shapes of the articles. However, this packaging lacks protection as Styrofoam (EPS) breaks when dropped, loosens against the article, and will eventually fail if dropped multiple times. Further, an article is protected with foldable corrugated configuration which wraps around the article shape. However, this packaging is time consuming to assemble and to package the article, and also as the corrugated material gets damaged when dropped and also loosens against the article. Accordingly, a packaging assembly including a packaging material provides an easily configurable shape that may be customized to efficiently package a given article and readily reusable and more easily disposed of.

SUMMARY

The present disclosure relates to a foam packaging assembly for protecting an article during storage and transport. According to an exemplary aspect of the present disclosure, the foam packaging assembly includes one or more pads, a container configured to receive the article or an inner box storing the article, and using at least one input variable of the article or the inner box, a configurator determines a first determination comprising one or more dimensions of the container and a second determination comprising a number of the pads disposed in the container.

According to a further aspect of the present disclosure, the at least one input variable is a first packaging configuration. Using the first packaging configuration and the second determination, the configurator determines a first arrangement of the pads inside the container. The first arrangement includes the pads being disposed adjacent a first portion of the container and a substantially opposing second portion of the container, and the article or the inner box can be disposed between the pads inside the container.

According to a further aspect of the present disclosure, the at least one input variable is a second packaging configuration. Using the second packaging configuration and the second determination, the configurator determines a second arrangement of the pads inside the container, the second arrangement includes the pads coupled to an insert board and configured to be disposed adjacent a first portion of the container, and the article or the inner box can be disposed adjacent to the pads inside the container.

According to a further aspect of the present disclosure, in the second packaging configuration, the configurator uses the at least one input variable to determine a third determination comprising one or more dimensions of the insert board. In the second arrangement, the pads include at least one corner pad and/or at least one side pad attached to the insert board. Further, the insert board includes at least one score marked substantially along a length direction of the insert board. The insert board is configured to be at least partially folded at the at least one score marked as the insert board is inserted into the container.

According to a further aspect of the present disclosure, one or more of the pads includes a first identifier coupled to a first surface of the one or more pads such that each first surface is configured for disposal inside the container in a first orientation. In particular, one or more of the pads include a first identifier coupled to a first surface of the one or more pads such that each first surface is attached in the second arrangement to the insert board.

According to a further aspect of the present disclosure, the one or more pads include at least one corner pad formed as a single unit that includes a base segment, a first sub-segment, and a second sub-segment. In a folded corner configuration, the corner pad includes two dovetail sections extending from the base segment toward each of the first and second sub-segments when the first and second sub-segments are configured to be folded substantially perpendicular to the base segment. A length of each of the dovetail sections extending from the base segment is substantially the thickness of the first sub-segment and/or the second sub-segment. Further, in the folded corner configuration, each of the dovetail sections includes at least one ear portion configured to position the first and second sub-segments into a substantially perpendicular position relative to the base segment.

According to a further aspect of the present disclosure, the one or more pads include at least one side pad configured to be disposed in the container adjacent two opposing corner pads. In a folded side configuration, at least one side pad includes a base segment and a sub-segment configured to be folded substantially perpendicular to the base segment, and the at least one side pad includes at least one dovetail section extending from the base segment toward the sub-segment.

According to another aspect of the present disclosure, a method using a foam packaging assembly to protect an article includes the steps of receiving, by configurator, at least one input variable corresponding to the article or an inner box storing the article, determining, by the configurator, a first determination comprising one or more dimensions of a container receiving the article or the inner box, determining, by the configurator, a second determination comprising a number of pads, and outputting, by the configuration, the first and second determinations to a user interface.

According to a further aspect of the present disclosure, the method further includes the steps of receiving, by the configurator, at least one input variable, which is a packaging configuration that includes an insert board, and determining, by the configurator, a third determination comprising one or more dimensions of the insert board for disposal in the container.

Further details and benefits will become apparent from the following detailed description of the appended drawings. The drawings are provided herewith purely for illustrative purposes and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
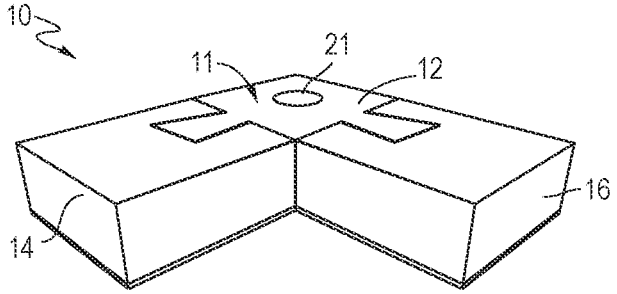
FIG. 1 shows a perspective view of an unfolded corner pad according to the present disclosure.

The drawings described herein are for illustration purposes only and are not intended to limit the scope of the present disclosure in any way.

DETAILED DESCRIPTION

The following description is merely exemplary in nature and is in no way intended to limit the present disclosure or its application or uses. It should be understood that throughout the drawings, corresponding reference numerals indicate like or corresponding parts and features.

Figure 1A:
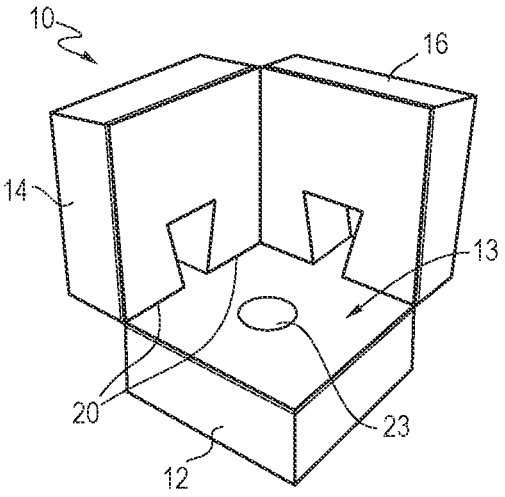
FIG. 1A shows an inner perspective view of the folded corner pad of FIG. 1 according to the present disclosure.
Figure 1B:
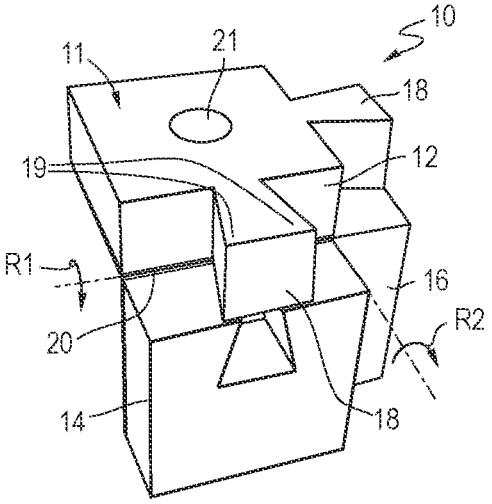
FIG. 1B shows an outer perspective view of the folded corner pad of FIG. 1 according to the present disclosure.

FIG. 1 is a perspective view of a thermoplastic corner pad in accordance with an exemplary embodiment of the present disclosure, FIGS. 1A and 1B are perspective views of the folded corner pad of FIG. 1. In FIG. 1, the corner pad 10 has a base segment 12 and two sub-segments 14 and 16. As shown in FIGS. 1, 1A and 1B, the base segment 12 and each of the sub-segments 14 and 16 are folded to form an L-shape respectively, and the folded pad may be configured into a corner pad 10 by rotating each of the end sub-segments 14 and 16 in the direction of R1 and R2. Further, the corner pad 10 has one dovetail section 18 formed in each of the sub-segments 14 and 16 to ensure that the sub-segments 14 and 16 remain essentially perpendicular to the base segment 12 when the sub-segments 14 and 16 are each folded to form in the corner pad 10, which is defined as a folded corner pad configuration.

As shown in FIGS. 1, 1A, and 1B, each of the dovetail sections 18 is cut into each of the sub-segments 14 and 16, and a connecting hinge portion 20 may be used to connect the sub-segments 14 and 16 with the base segment 12. Further, the connecting hinge portion 20 may be located on either side of the dovetail section 18 (see FIG. 1B). Accordingly, the base segment 12 and each of the sub-segments 14 and 16 remain connected and each of the sub-segments 14 and 16 may be rotated to form a corner pad 10. For example, as shown in FIGS. 1A and 1B, the sub-segments 14 and 16 are each rotated by substantially 90 degrees and held in the position to configure into the corner pad 10. By controlling the width and thickness of the connecting hinge portion 20, the rotation angle may be controlled and the rotation angle between the base segment 12 and each of the sub-segments 14 and 16 may be different in accordance with other embodiments of the present disclosure.

Further, in accordance with other embodiments of the present disclosure, the dovetail section 18 may be formed with any other forms of the geometry. So, when the sub-segments 14 and 16 are each rotated to a substantially perpendicular configuration relative to the base segment 12, such geometry is one that creates an interference as between the base segment 12 and each of the sub-segments 14 and 16. Accordingly, they remain in a position for use in packaging as a corner pad. When the sub-segments 14 and 16 are each rotated in the direction of arrows R1 and R2 around the hinge portions 20 relative to the base segment 12, the dovetail sections 20 of the base segment 12 is cleared from the inner wall of the sub-segments 14 and 16, and separated from the sub-segments 14 and 16. So, in the folded corner pad configuration of FIG. 1B, the ear portions 19 of the dovetail section 18 may clear the side wall and recover their original shape to act as a locking mechanism to ensure that the sub-segments 14 and 16 are substantially perpendicular to the base segment 12. Accordingly, the sub-segments 14 and 16 may be retained by the dovetail section 18 in a position substantially perpendicular to the base segment 12 (see FIGS. 1A and 1B).

In accordance with an exemplary embodiment of the present disclosure, the base segment 12 and the sub-segments 14 and 16 are each about 3 inches square, and also the segments are about 2 inches thick and preferably about 1.687 inches thick. Further, the dovetail section extends about 1.625 inches into the sub-segments 14 and 16 from the base segment 12, and has a width about 1.5 inches across the ear portions 19 and about 1.125 inches at its narrowed portion, which is located at the connecting location with the base segment 12. Accordingly, as shown in the folded corner pad configuration of FIG. 1B, the length of the dovetail section 18 may substantially match to or may be little less than the thickness of the sub-segments 14 and 16 to provide the folded configuration of the corner pad 10. In accordance with other embodiments of the present disclosure, the dimensions of the corner pad 10 may be changed according to the size of the articles and/or the inner box 102 storing the article (i.e., depending on the application requirements, see FIG. 4B). The corner pads 10, in general, may be located at the top and bottom corners of an inner box 102 storing an article or an article itself, which is packaged and stored by the container 100 (i.e., an outer box). In some embodiments, the inner box is formed with other shapes such as a circular shape or a polygonal shape according to the article's shape or size.

Figure 4A:
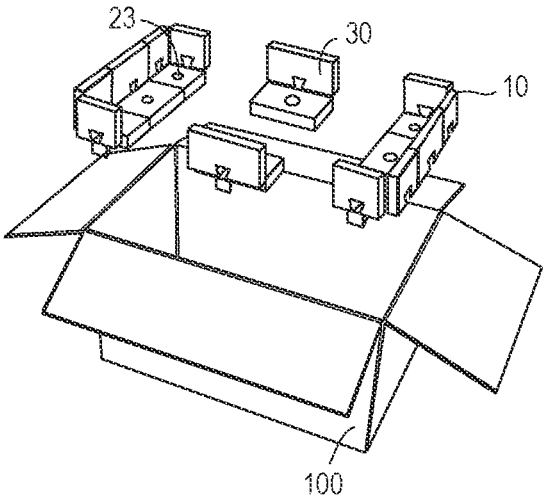
FIGS. 4A-4C show a packaging assembly process of the article with a plurality of pads placed inside the container according to the present disclosure.
Figure 4B:
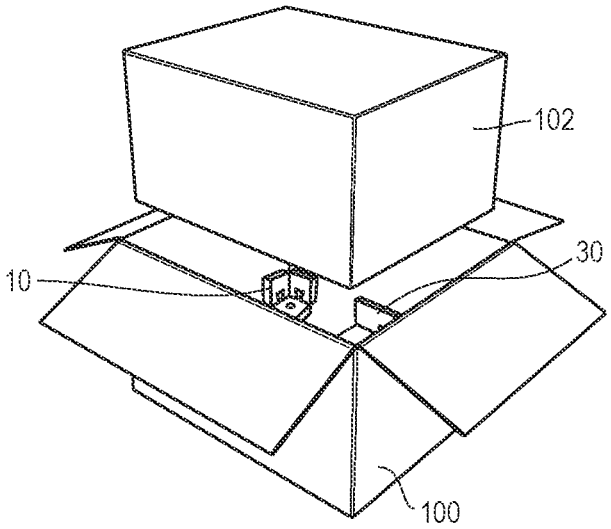
Figure 4C:
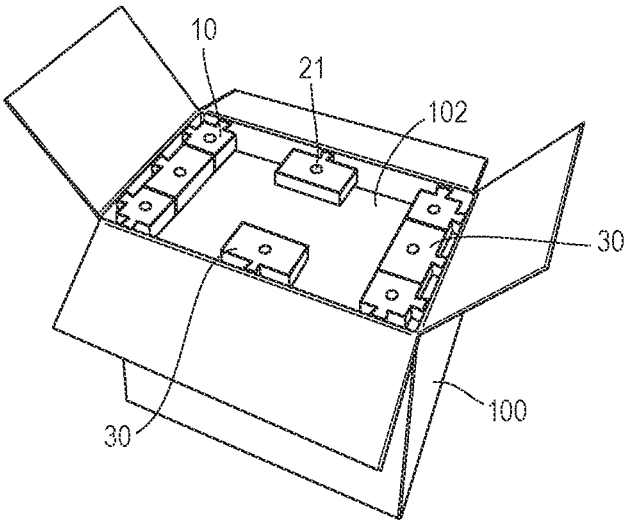

Further, as shown in FIGS. 1-1B, the corner pad 10 has a first identifier 21 and a second identifier 23. The first identifier 21 is coupled to a first surface 11 of the base segment 12 of the corner pad 10 and the second identifier 23 is attached to a second surface 13 of the base segment 12 of the corner pad 10. As shown in FIGS. 1A-1B, for example, the first and second identifiers 21 and 23 are each glued on each of the first and second surfaces 11 and 13 of the corner pad 10. In some embodiments, the identifier may be coupled to the surface of the pads with other forms of bonding methods including adhesives, chemical bonding, etc. Further, in some embodiments, the identifier may be formed on the surface with other forms of processing method including a marking, a cutting, etc. In FIG. 1B, the first surface 11 of the corner pad 10 having the first identifier 21 is faced upward to position the corner pads 10 in a first orientation, which is an optimal orientation of the corner pad 10 to effectively protect the article inside the container 100 when the corner pads 10 are placed in a first portion of the container 100 (e.g., the top location of the inner box or the article as shown in FIG. 4C). In FIG. 1A, the second surface 13 of the corner pad 10 having the second identifier 23 is faced upward to position the corner pad 10 in a second orientation, which is another optimal orientation of the corner pad 10 in an opposing second portion (e.g., the inside bottom location of the container 100 as shown in FIGS. 4A and 4B) opposite from the first portion of the container 100. Accordingly, each of the first and second identifiers 21 and 23 coupled to the corner pads 10 allows a user or an automatic packaging machine to place the corner pads 10 inside the container 100 quickly and correctly.

For example, in FIGS. 4A-4C, when one or more corner pads 10 are placed in the second portion of the container 100 (i.e., in the inside bottom of the container), the second surface 13 having the identifier 23 of the corner pads 10 is faced upward and disposed in the container 100 in the second orientation of the corner pad 10. When one or more corner pads 10 are placed in the first portion of the container 100 (i.e., over the top of the article or the inner box 102), the first surface 11 having the identifier 21 of the corner pads 10 is also faced upward and disposed in the container in the first orientation of the corner pad 10. Accordingly, due to the first and second identifiers 21 and 23 of the corner pads 10, the user or automatic machine may be able to place the corner pads 10 in each of the first and second portions of the container 100 quickly in the first and second orientations of the corner pads 10 such that the pads 10 inside the container 100 provide the effective protection for the article. Further, as shown in FIGS. 1A and 1B, the first and second identifiers 21 and 23 are in the form of a circular shape, but the identifiers 21 and 23 may be formed with other shapes such as a rectangular shape in accordance with other embodiments of the present disclosure.

Figure 2:
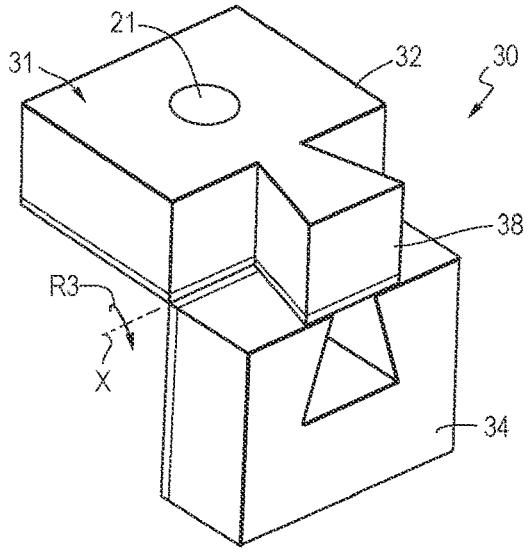
FIG. 2 shows an outer perspective view of a folded side pad having a dovetail section according to the present disclosure.
Figure 2A:
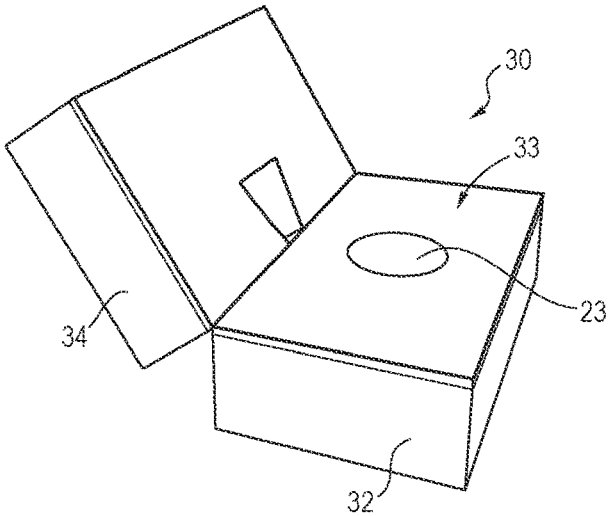
FIG. 2A shows an inner perspective view of the folded side pad of FIG. 2 according to the present disclosure.

FIGS. 2 and 2A are perspective views of a first side pad 30 having one dovetail section 38 with the folded sub-segment in the present disclosure. As shown in FIG. 2, the first side pad 30 includes a base segment 32 and a sub-segment 34 such that the first side pad 30 may be configured into a side pad by rotating the sub-segment 34 in the direction of R3. Further, the first side pad 30 has one dovetail section 38, which is generally formed with the same design (i.e., same dimensions) as the dovetail section 18 of the corner pad 10 shown in FIG. 1. Accordingly, as shown in FIG. 2, the first side pad 30 has the dovetail section 38 formed in the sub-segment 34 to ensure that the sub-segment 34 remain essentially perpendicular to the base segment 32 when the sub-segment 34 is folded to form in the side pad, which is defined as a folded side pad configuration. In some embodiments, the thickness, shape, and size of the first side pad 30 may vary depending on the application requirements.

Figure 3:
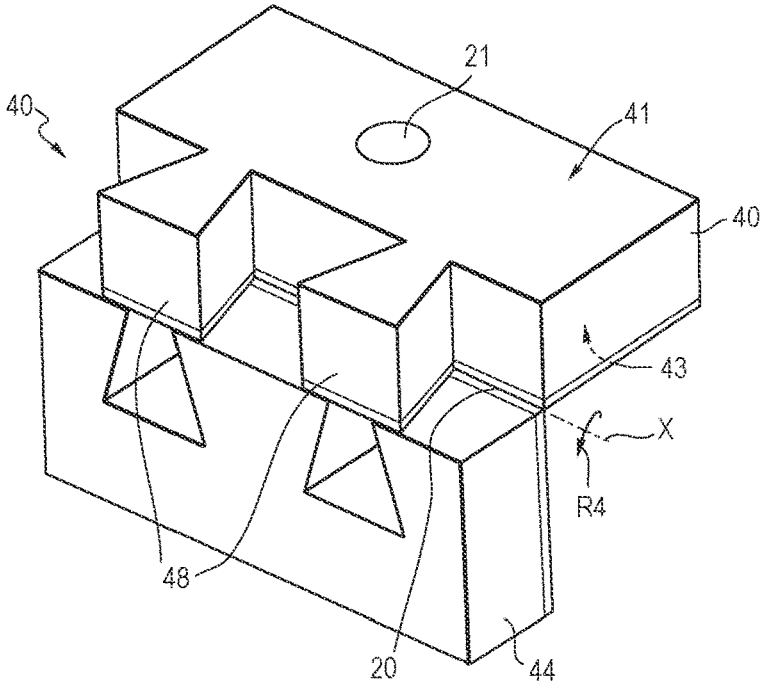
FIG. 3 shows an outer perspective view of a folded side pad having two dovetail sections according to the present disclosure.

FIG. 3 is a perspective view of a second side pad 40 having at least two dovetail sections 48 in the folded sub-segment in the present disclosure. As shown in FIG. 3, the second side pad 40 includes a base segment 42 and a sub-segment 44 such that the second side pad 40 may be configured into a side pad by rotating the sub-segment 44 in the direction of R4. Further, the second side pad 40 has at least two dovetail sections 48, which are each formed with the same design (i.e., same dimensions) as the dovetail section 18 of the corner pad 10 shown in FIG. 1. Accordingly, as shown in FIG. 3, the second side pad 40 has at least two dovetail sections 48 formed in the sub-segment 44 to ensure that the sub-segment 44 remain essentially perpendicular to the base segment 42 when the sub-segment 44 is folded to form in the side pad, which is defined as a folded second side configuration. In some embodiments, the thickness, shape, and size of the second side pad 40 can vary depending on the application requirements.

Further, as shown in FIGS. 2 and 3, the number of the dovetail section in the side pads 30 and 40 is generally dependent on the length of the side pad along a longitudinal direction X, which is parallel to the connecting hinge portion 20. In accordance with other embodiments of the present disclosure, the side pad may have more than two dovetail sections along the longitudinal direction X of the side pad. Further, the base segment and the sub-segment in the first and second side pads 30 and 40 are each about 2 inches thick (preferably 1.687 inches thick) but the size (i.e., a length and a width) of the side pads are different from each other along the longitudinal direction X before the side pads are folded. The first and second side pads 30 and 40, in general, may be placed between the corner pads 10 at top and bottom over the inner box or article packaged and stored in the container (see FIG. 4B). In addition, as shown in FIGS. 2, 2A, and 3, each of the first and second side pads 30 and 40 also has the first and second identifiers 21 and 23, which are each coupled to the first surface 31 and 41 and the second surface 33 and 43 of the base segments 32 and 42. As described in the corner pad 10, the first identifier 21 of the side pads 30 and 40 allows the user or the automatic machine to position the side pads 30 and 40 inside the container in the first orientation of the side pads 30 and 40, and also the second identifier 23 of the side pads 30 and 40 allows the user or the automatic machine to position the side pads 30 and 40 inside the container in the second orientation of the side pads 30 and 40.

FIGS. 4A-4C show the packaging assembly process of the inner box 102 storing the article with a plurality of corner and side pads 10 and 30 (with no an insert board) defined as a first packaging configuration. In FIGS. 4A-4C, when the inner box 102 storing the article is disposed in the packaging container 100, one or more pads including the corner pads 10 and the first side pads 30 are each positioned between the inner box 102 and the packaging container 100 to protect the article. Some of the corner and side pads 10 and 30 are disposed and spaced apart from each other in the first portion of the container 100 (i.e., the top location of the container) and the others are also disposed and spaced apart from each other in the opposing second portion of the container (i.e., the bottom location of the container). For example, in FIGS. 4A-4C, four corner pads 10 and four side pads 30 in each of the top and bottom locations of the container 100 are disposed in the packaging container 100 without the insert board, which is defined as a first arrangement of the pads.

As shown in FIGS. 4A-4C, in the first packaging configuration, some of the corner and side pads 10 and 30 disposed in the bottom location of the container 100 have the second identifier 23 faced upward. After that, the inner box 102 storing the article is placed inside the packaging container 100 such that the inner box 102 sits on the pads 10 and 30 disposed in the inside bottom of the packaging container 100. Finally, other corner and side pads 10 and 30 disposed in the top location of the packaging container 100 have the first identifier 21 faced upward. Accordingly, in the first packaging configuration, the first arrangement of the pads inside the container is configured to efficiently protect the inner box 102 storing the article. Further, due to the identifiers 21 and 23, each of the pads could be quickly and correctly placed inside the container 100 such that the assembly time and labor could be saved.

Figure 5:
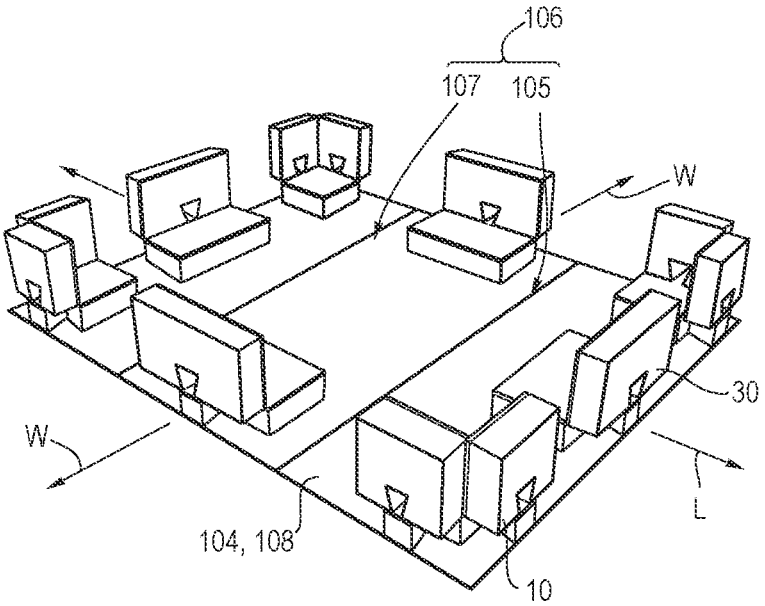
FIG. 5 shows a perspective view of an insert board with a plurality of pads according to the present disclosure.

FIG. 5 is a perspective view of the corner and side pads 10 and 30 coupled to an insert board 104, which is defined as a second arrangement of the pads in the present disclosure. In FIG. 5, the insert board 104 is formed with a rectangular shape. In some embodiments, the insert board 104 may be formed with other shapes such as a square shape, a circular shape, any other shapes according to the shape of the container, inner box, and/or article, etc. In FIG. 5, the corner pads 10 are each positioned in the corner of the insert board 104, and the side pads 30 are each positioned between the corner pads 10 along the perimeter edge of the insert board 104 and spaced apart from the corner pads 10. In some embodiments, the corner and side pads may be attached to the insert board in the different arrangements of the pads according to the different application in the packaging assembly. As shown in FIG. 5, due to the insert board 104, the corner and side pads 10 and 30 coupled (or attached) to the insert board 104 could be placed inside the packaging container 100 at one time in each of the top and bottom locations of the container 100 such that the packaging assembly labor and time for the articles could be saved. In general, the insert board 104 having the corner and side pads 10 and 30 for protecting the article may be used in a high volume package assembly to save the packaging time and labor.

Further, as shown in FIG. 5, the insert board 104 has at least one score 106 formed perpendicularly to the length direction L of the insert board 104 to be folded along the score such that the insert board 104 having the corner and side pads 10 and 30 could be placed easily over the top area of the inner box 102 in the packaging container 100. In some embodiments, the score 106 may be formed perpendicularly to a width direction W of the insert board, in any other ways such as diagonally, etc. For example, when the pads attached to the insert board 104 are placed over the top of the inner box 102 storing the article, the scores 106 formed in the insert board 104 may be at least partly folded along the score 106 such that the corner and side pads are efficiently disposed between the inner box 102 storing the article and the container 100 (see FIG. 6C).

Further, in the second packaging configuration, the pads 10 and 30 have at least the first identifier 21 attached to or glued on the first surfaces 11 and 31 of the pads 10 and 30, and the first surfaces 11 and 31 of the pads 10 and 30 are each attached to the insert board 204 by one of the bonding methods such as using an adhesive material. Accordingly, the first identifier 21 attached to the pads 10 and 30 could be used to indicate the surface for attaching the pads to the insert board 104 such that the first surfaces 11 and 31 of the corner and side pads 10 and 30 are each attached to the insert board 104 with the first orientation of the pads. Further, the score 106 of the insert board 104 is formed perpendicularly in the length direction L of the insert board 104 between two adjacent pads attached to the insert board 204. For example, in FIG. 5, the first and second scores 105 and 107 are each formed between one of the corner pads 10 and the first side pad 30 perpendicularly in the length direction of the insert board 104.

Figure 6A:
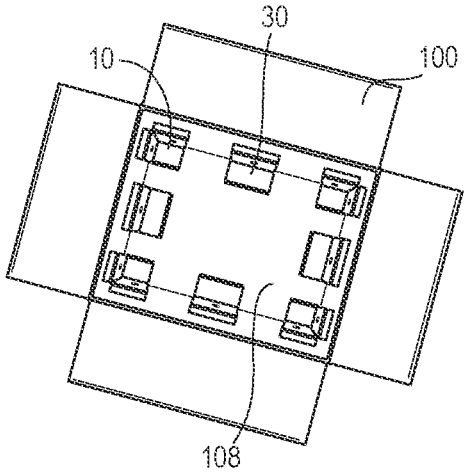
FIGS. 6A-6D show a packaging assembly process using the insert board of FIG. 5 according to the present disclosure.
Figure 6B:
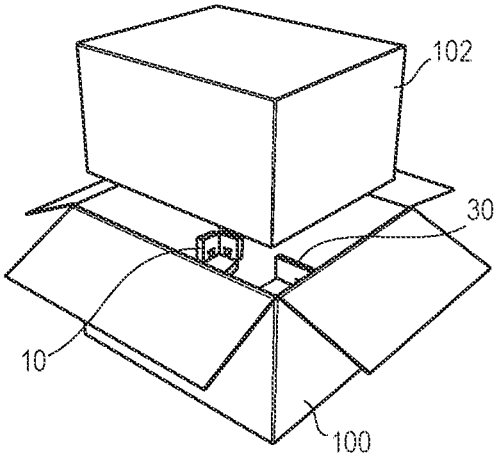
Figure 6C:
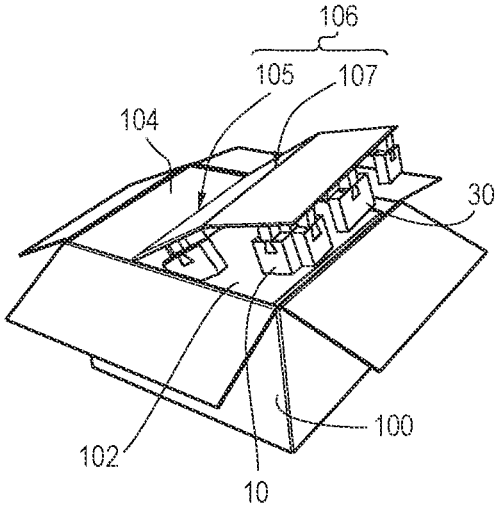
Figure 6D:
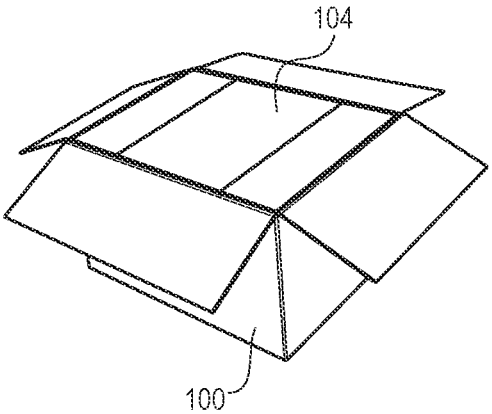

FIGS. 6A-6D show the packaging assembly process of the inner box 102 storing the article with a plurality of corner and side pads 10 and 30 attached to the insert board 104 inside the container 100 in the second packaging configuration. In FIG. 6A, for example, a second insert board 108 having some of the pads 10 and 30 (see FIG. 5) is disposed in the inside bottom of the packaging container 100 (i.e., the opposing second portion of the container 100), and in FIG. 6B, the inner box 102 storing the article is placed inside the packaging container 100 such that the inner box 102 sits on the pads 10 and 30 disposed in the inside bottom of the packaging container 100. In FIG. 6C, a first insert board 104 having additional corner and side pads 10 and 30 is inserted over the top of the inner box 102 inside the packaging container 100 (i.e., the first portion of the container 100). As the first insert board 104 is inserted over the top of the inner box 102, the scores 106 formed in the first insert board 104 are at least partly folded one by one along the line of the score. In FIG. 6D, finally, the first insert board 104 having the plurality of pads 10 and 30 covers the top of the inner box 102 in the packaging container 100 such that the corner and side pads 10 and 30 attached to the insert board 104 in the second arrangement of the pads could protect the articles during storage or transport.

Figure 7:
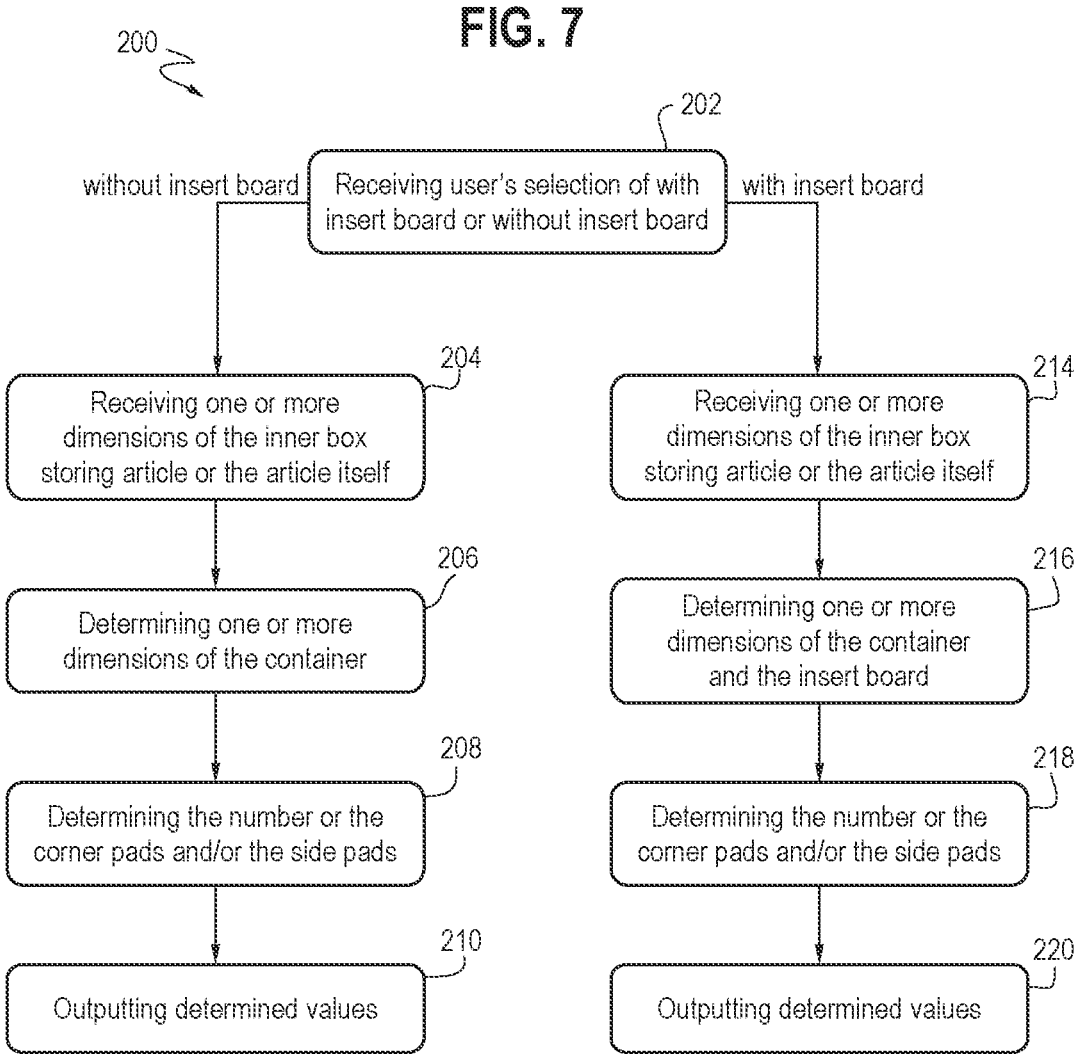
FIG. 7 shows a flow chart of a configurator used for a packaging assembly according to the present disclosure.

FIG. 7 generally illustrates an exemplary method 200 having a process of a foam packaging configurator, such as a configurator 150 (see FIGS. 7A and 7B) used in the foam packaging assembly. The configurator 150 is designed to provide a user (i.e., a customer) with outputs such as the dimensions (a length, a width, and a depth) of the packaging container 100, the dimensions (a length and a width) of the insert board 104, the number of the corner and/or side pads 10, 30, and 40, etc. Further, the configurator 150 allows the user to select the first or second packaging configuration described above as one of the input variables. In the configurator 150, if the user selects an option (i.e., without insert board), the configurator 150 provides the user with a first output 152 having one or more dimensions of the container 100 and/or the number of the corner and/or side pads 10, 30, and 40, which is defined as the first packaging configuration. In the configurator 150, if the user selects another option (i.e., with insert board), the configurator 150 provides the user with a second output 154 having one or more dimensions of the insert board in addition to the first output 152, which is defined as the second packaging configuration. In FIG. 7, the method 200 may be performed by the processing logic that may include hardware (circuitry, dedicated logic, etc.), software, or a combination of both. The configurator 150 may be performed by one or more processors of a computing device with a user interface 151 implementing the method 200. The user interface 151 is generally connected to a personal computer or a tablet device such as a tablet computer or smartphone, which is held manually by the user to implement the method and shows the first output 152 or the second output 154 based on the user's selection described above via the personal computer screen or tablet device. Further, the method 200 may be implemented as computer instructions stored on a memory device and executable by the one or more processors.

Figure 7A:
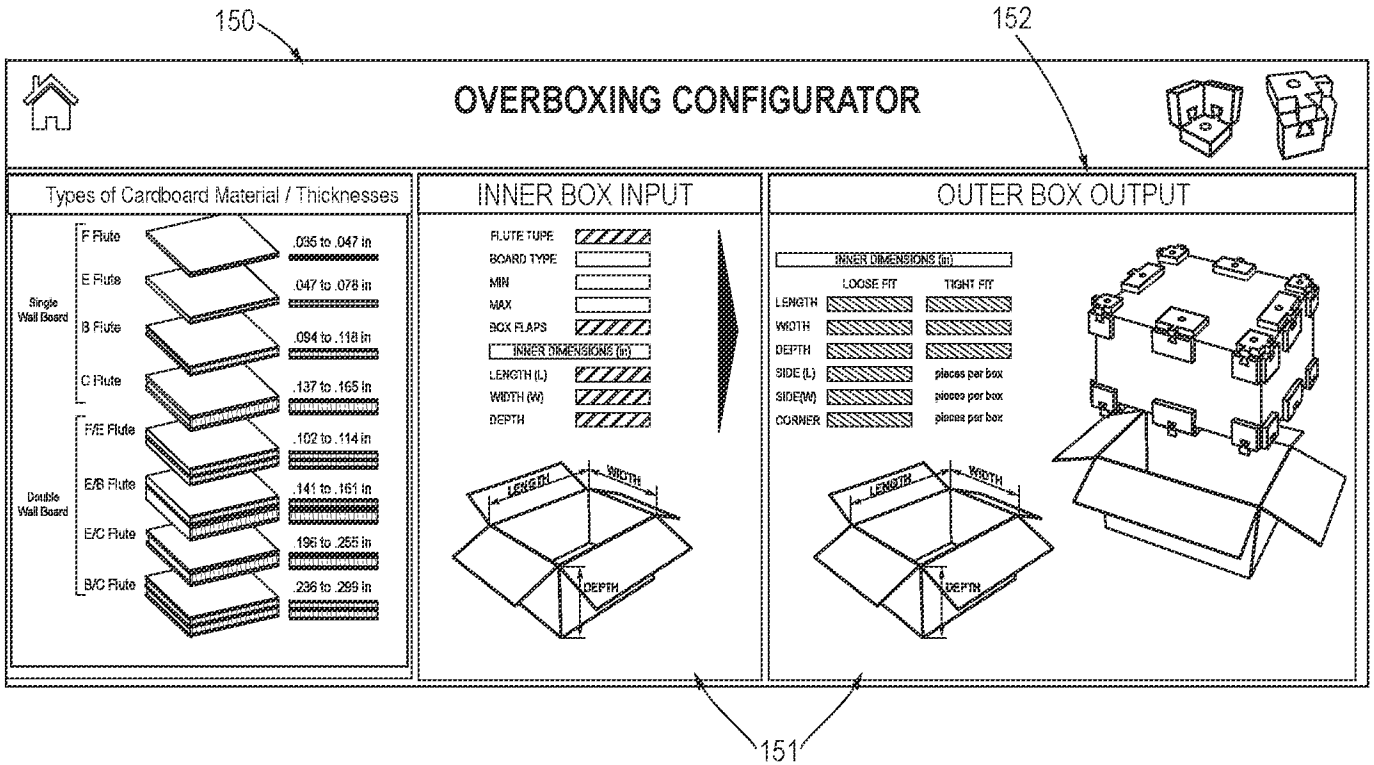
FIG. 7A shows a first output without the dimensions of the insert board determined by the configurator of FIG. 7 according to the present disclosure.
Figure 7B:
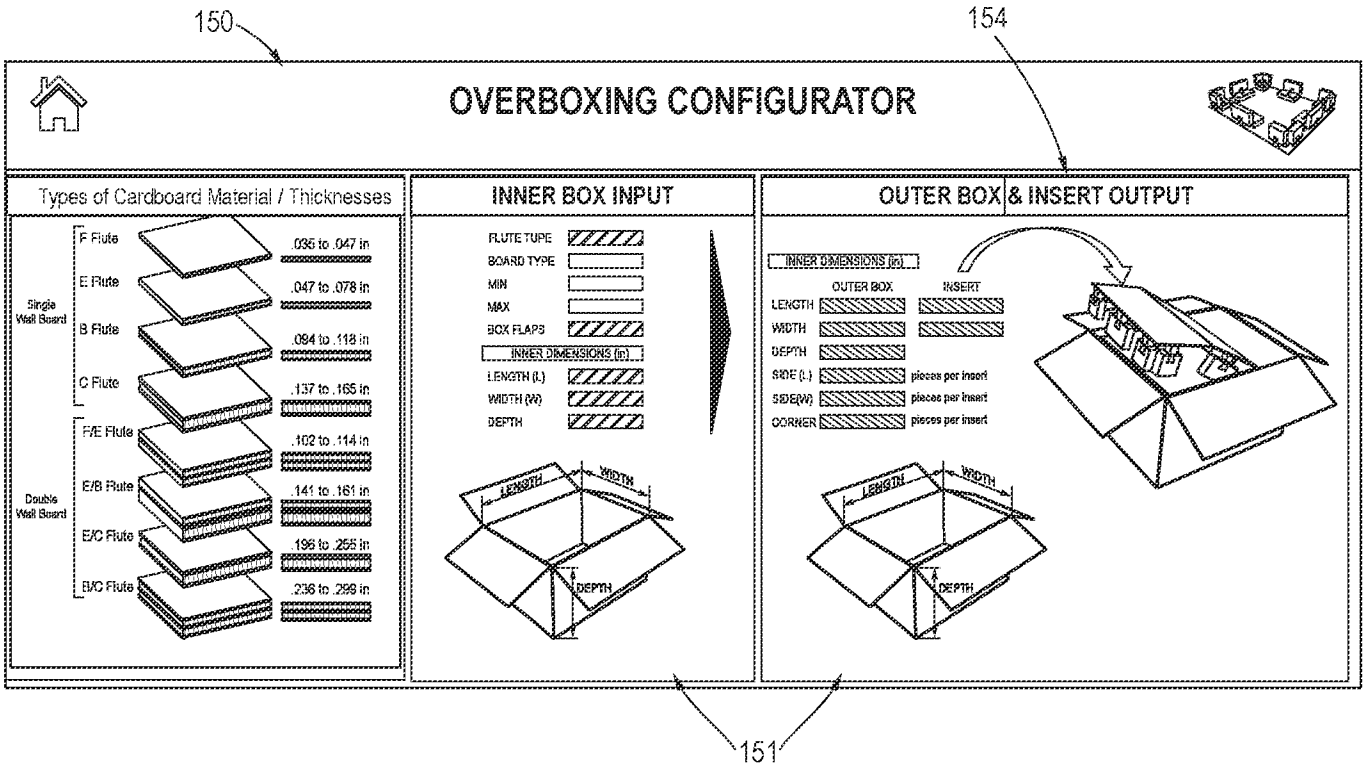
FIG. 7B shows a second output with the dimensions of the insert board determined by the configurator of FIG. 7 according to the present disclosure.

FIGS. 7A and 7B show two different packaging configurations with the first output 152 and the second output 154 of the foam packaging configurator 150, which may be displayed on the user's tablet device, appropriate computer screen, or any other desired device with the user interface. In some embodiments, the configurator 150 may provide the user with more than two different packaging configurations according to the user's selection. In the first packaging configuration of FIG. 7A, the first output 152 includes one or more dimensions of the container 100, the number of the corner and/or side pads 10, 30, and 40, and any other desired information for use without the insert board 104. In the second packaging configuration of FIG. 7B, the second output 154 includes one or more dimensions of the container 100, one or more dimensions of the insert board 104, the number of the corner and/or side pads 10, 30, and 40, and any other desired information. As shown in FIG. 7B, the second output 154 having the one or more dimensions of the insert board 104 is generally used in a high volume packaging assembly. However, the user may select either option such as with the insert board 104 or without the insert board 104 in the configurator 150 according to the user's preference regardless of the volume of the packaging assembly.

In block 202, the configurator 150 receives one of the options (with insert board or without insert board) according to the user preference. So if the user needs the corner and side pads attached to the insert board 104 (i.e., the second arrangement of the pads), the user may select the option of with insert board to have the one or more dimensions of the insert board 104 as one of the outputs in the configurator 150. If the user does not need the insert board 104 (i.e., the first arrangement of the pads), the user may select the option of without insert board to have the individual corner and side pads, which are individually inserted over the article inside the container without the insert board 104. In each of blocks 204 and 214, after selecting one of the previous options, the configurators 150 further allows the user to input at least one variable including one or more dimensions (e.g., length, width, or depth) of the inner box 102 storing the article or the article itself. Further, as shown in FIGS. 7A and 7B, the configurator 150 may allow the user to select the type of flute and/or box flaps based on the menu listed in the configurator 150.

In each of blocks 206 and 216, the configurator 150 calculates and determines one or more dimensions such as a length, a width, and/or a depth of the packaging container 100 defined as a first determination. In some embodiments, the container may be formed with other shapes such as a circular shape or other polygonal shape such that the configurator could calculate and determine one or more dimensions according to the container's shape (e.g., in the circular shape, the configurator is able to determine a diameter of the circular container). In general, the configurator 150 calculates the dimensions of the container 100 based on the inputted dimensions of the inner box 102 and the dimensions of the corner and side pads 10, 30, and 40. In block 216, further, the configurator 150 calculates and determines one or more dimensions such as a length and/or a width of the insert board 104 defined as a third determination to provide the corner and side pads, which are each attached to the insert board 104 in the second packaging configuration. For example, the third determination could be determined based on the input variables such as the dimensions of the inner box or the article, or could be determined based on the first determination (i.e., the size of the container) in the second packaging configuration. In each of blocks 208 and 218, the configurator 150 calculates and determines the number of the corner pads 10, and/or the number of the first and/or second side pads 30 and 40, which is defined as a second determination.

In each of blocks 210 and 220, as shown in FIGS. 7A and 7B, the configurator 150 determines and shows the outputs 152 and 154 such as the dimensions of the container 100, the dimensions of the insert board 104, and/or the number and/or types (e.g., size) of the corner and side pads. Further, as shown in FIG. 7A, the configurator 150 determines and outputs one or more selections, such as "Loose fit" and "Tight Fit," for a user to choose the dimensions of the container 100 to package the inner box 102 storing the articles according to the user's preference. Accordingly, the configurator 150 determines and outputs the dimensions of the packaging containers (i.e., the outer box) with the number of the pads based on the input variables and also the dimensions of the pads for the robust protection of the article.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the disclosure in various forms and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A foam packaging assembly for protecting an article optionally stored in an inner box, at least one of the article and inner box having a dimension which defines a first input variable, the foam packaging assembly comprising:

one or more pads;

a container receiving the article or the inner box storing the article; and a processor configured to use the first input variable of the article or the inner box, and determine a first determination comprising one or more dimensions of the container and a second determination comprising a number of the pads disposed in the container, wherein the processor is further configured to use a second input variable and determine one of a first packaging configuration including a first arrangement of the pads without an insert board and a second packaging configuration including a second arrangement of the pads coupled to the insert board.

2. The foam packaging assembly of claim 1, wherein the processor is configured to use the first packaging configuration and the second determination, and determine the first arrangement of the pads inside the container, the first arrangement includes the pads being disposed adjacent a first portion of the container and a substantially opposing second portion of the container, and the article or the inner box can be disposed between the pads inside the container.

3. The foam packaging assembly of claim 1, wherein in the second packaging configuration, the second arrangement of the pads coupled to an insert board and configured to be disposed adjacent a first portion of the container, and the article or the inner box can be disposed adjacent to the pads inside the container.

4. The foam packaging assembly of claim 1, wherein, in the second packaging configuration, the processor is configured to use the first input variable to determine a third determination comprising one or more dimensions of the insert board.

5. The foam packaging assembly of claim 3, wherein, in the second arrangement, the pads include at least one corner pad and/or at least one side pad attached to the insert board.

6. The foam packaging assembly of claim 3, wherein the insert board includes at least one score marked substantially along a length direction of the insert board.

7. The foam packaging assembly of claim 6, wherein the insert board is configured to be at least partially folded at the at least one score marked as the insert board is inserted into the container.

8. The foam packaging assembly of claim 2, wherein one or more of the pads include a first identifier coupled to a first surface of the one or more pads such that each first surface is configured for disposal inside the container in a first orientation.

9. The foam packaging assembly of claim 3, wherein one or more of the pads include a first identifier coupled to a first surface of the one or more pads such that each first surface is attached in the second arrangement to the insert board.

10. The foam packaging assembly of claim 1, wherein the one or more pads include at least one corner pad formed as a single unit that includes a base segment, a first sub-segment, and a second sub-segment.

11. The foam packaging assembly of claim 10, wherein, in a folded corner configuration, the corner pad includes two dovetail sections extending from the base segment toward each of the first and second sub-segments such that the first and second sub-segments are configured to be folded substantially perpendicular to the base segment.

12. The foam packaging assembly of claim 11, wherein a length of each of the two dovetail sections extending from the base segment is substantially the thickness of the first sub-segment and/or the second sub-segment.

13. The foam packaging assembly of claim 11, wherein, in the folded corner configuration, each of the two dovetail sections include at least one ear portion configured to position the first and second sub-segments into a substantially perpendicular position relative to the base segment.

14. The foam packaging assembly of claim 1, wherein the one or more pads further include at least one side pad configured to be disposed in the container adjacent two opposing corner pads.

15. The foam packaging assembly of claim 14, wherein, in a folded side configuration, each of the at least one side pad includes a base segment and a sub-segment configured to be folded substantially perpendicular to the base segment.

16. The foam packaging assembly of claim 15, wherein, in the folded side configuration, each of the at least one side pad includes at least one dovetail section extending from the base segment toward the sub-segment.

* * * * *